United States Patent [19]

Heider

[11] Patent Number: 4,487,312

[45] Date of Patent: Dec. 11, 1984

[54] PACKAGE FOR CARRYING TWO MULTICONTAINER PACKS

[75] Inventor: James E. Heider, Toledo, Ohio

[73] Assignee: Owens-Illinois, Inc., Toledo, Ohio

[21] Appl. No.: 474,075

[22] Filed: Mar. 10, 1983

[51] Int. Cl.[3] ..... B65D 75/00; B65D 75/28; B65D 71/00

[52] U.S. Cl. ..... 206/158; 206/151; 206/161; 206/427; 206/148

[58] Field of Search ..... 206/143–161, 206/427, 428; 294/87.2, 87 R; 229/52 BC

[56] References Cited

U.S. PATENT DOCUMENTS

| | | | |
|---|---|---|---|
| D. 238,249 | 12/1975 | Erickson | 294/87.2 |
| 2,989,177 | 6/1961 | Swick | 294/87 R |
| 3,167,347 | 1/1965 | Hewlings | 206/145 |
| 3,232,422 | 2/1966 | Whyte | 294/87.2 |
| 3,297,220 | 1/1967 | Leeburg | 294/87.2 |
| 3,404,773 | 10/1968 | Kirby, Jr. | 206/158 |
| 3,608,949 | 9/1971 | Owen | 206/150 |
| 3,653,504 | 4/1972 | Saumsiegle | 206/161 |
| 3,726,558 | 4/1973 | Klygis | 206/144 |
| 3,946,862 | 3/1976 | Klygis et al. | 206/150 |
| 4,139,094 | 2/1979 | Berry et al. | 206/158 |

*Primary Examiner*—William T. Dixson, Jr.
*Assistant Examiner*—Brenda J. Ehrhardt
*Attorney, Agent, or Firm*—John R. Nelson; Myron E. Click

[57] ABSTRACT

A package is provided that has connector carrier means for connecting a first multicontainer pack and a second multicontainer pack, each container having a top finish, each multicontainer pack having a top carrier for engaging the finish of a container, the connector engaging at least two of the finishes of the containers in each pack to provide a stable portable package.

10 Claims, 7 Drawing Figures

PACKAGE FOR CARRYING TWO MULTICONTAINER PACKS

The present invention relates to a package and method of carrying a family of multipack container carriers and, more particularly, to carrying two multipack container packs.

It is an object of the present invention to provide a convenient, sturdy, easily fabricated connector for joining together and carrying two multicontainer packs.

It is an object of the present invention to provide an outstanding consolidated package comprising a first and a second multicontainer pack and connector carrier means for carrying the packs and adapted for carrying the package from the top, each pack having an inner row of containers of at least two containers and an outer row of at least two containers, each container having a top finish, each pack having a top carrier that engages the top finish of each container, the connector being substantially planar means for carrying the package, the connector engaging the finish of each container in the row of the pack that is nearest the other pack to provide a stable package.

It is an object of the present invention to provide an easily fabricated, attractive, economical connector member preferably of a thermoplastic material such as polyethylene, the container joining together and connecting together two multicontainer packs.

These and other objects will be apparent from the specification that follows, the appended claims, and the drawings in which:

The present invention provides an easily fabricated, economical, sturdy connector for making an outstanding package from first and second multicontainer packs, each multicontainer pack comprising at least four containers, each container having a top finish, a top carrier for engaging the finish of each container in each of the first and second packs, the connector having means for joining and connecting the packs together and carrying the same to provide a stable, portable package.

Figure 1:
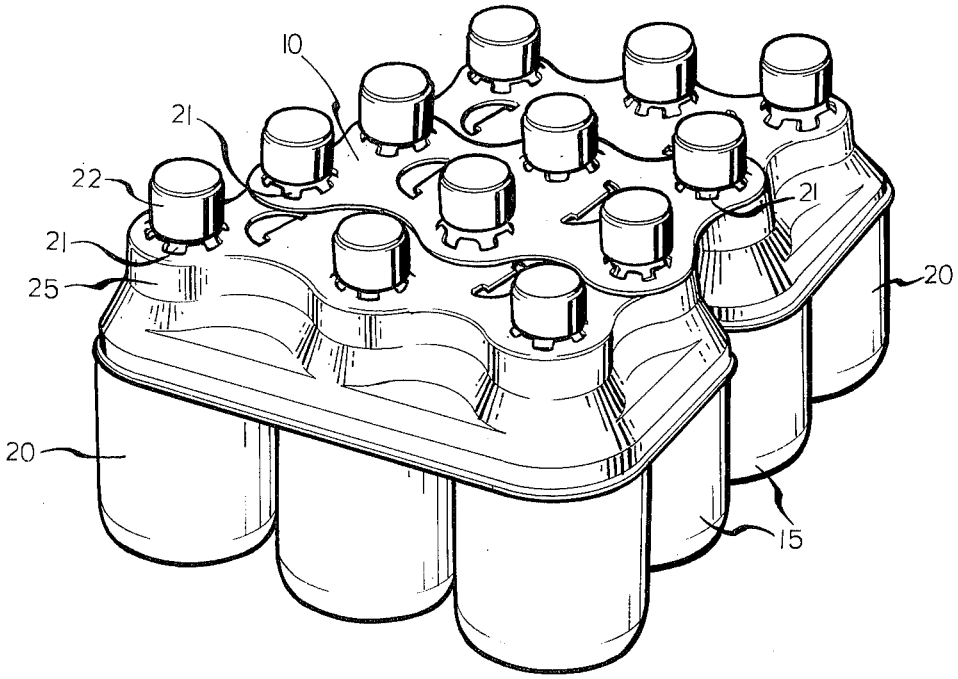
FIG. 1 is a perspective view showing the connector of the present invention connecting two six-packs to make a twelve-pack.

As seen in FIG. 1, a connector member 10 is provided to connect and join together two six-packs 15. Each six-pack has six bottles 20, each bottle with a bottle finish 21 and a cap 22. Each of the six-packs has a top carrier 25 to join together the six bottles. The easily made, easily used, and economical connector 10 engages preferably the finish portion of the bottles in the row of the six-pack that is adjacent the next six-pack to provide a sturdy, stable, portable package.

Figure 2:
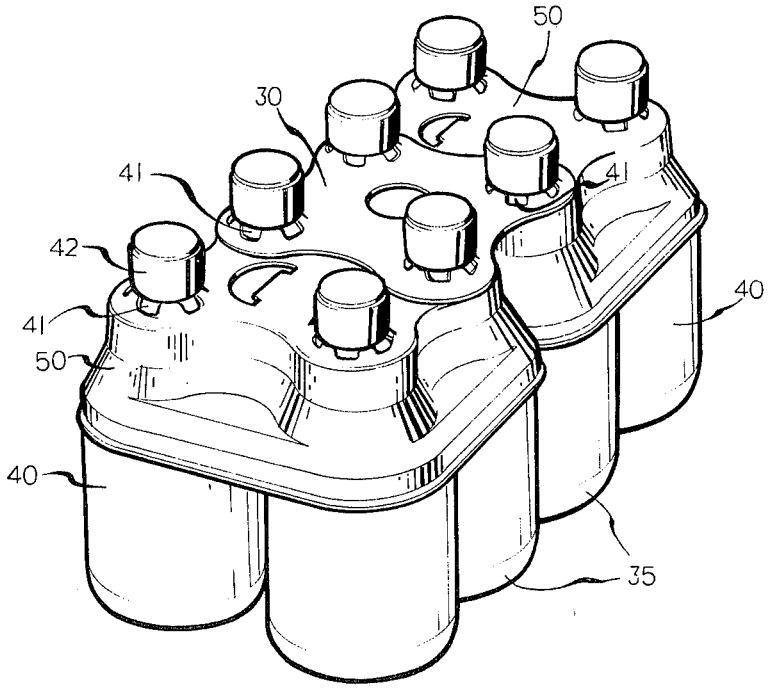
FIG. 2 is a perspective view of a connector that forms an eight-pack from two four-packs.

FIG. 2 shows a connector 30 for two separate four-packs 35. Each four-pack has four bottles 40, each bottle having a finish 41 and a cap 42. Each of the four-packs has a top carrier 50 for holding the four bottles together. The connector 30 advantageously engages the finish 41 of each of the two bottles in the row adjacent the other pack to form a sturdy portable package.

Figure 3:
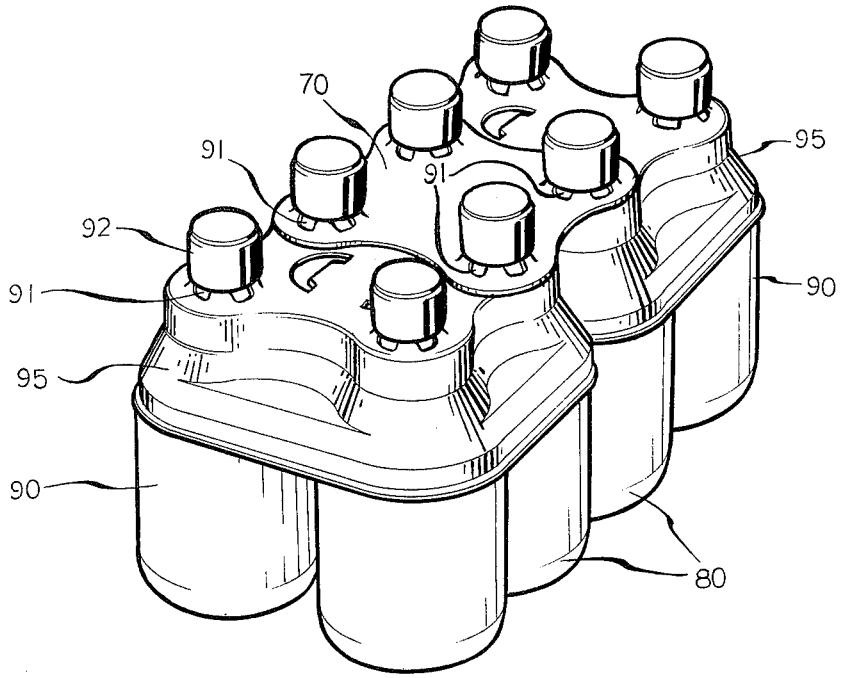
FIG. 3 is a perspective view of another embodiment of the present invention showing a connector with four holes therein connecting two four packs together to make an eight-pack.
Figure 4:
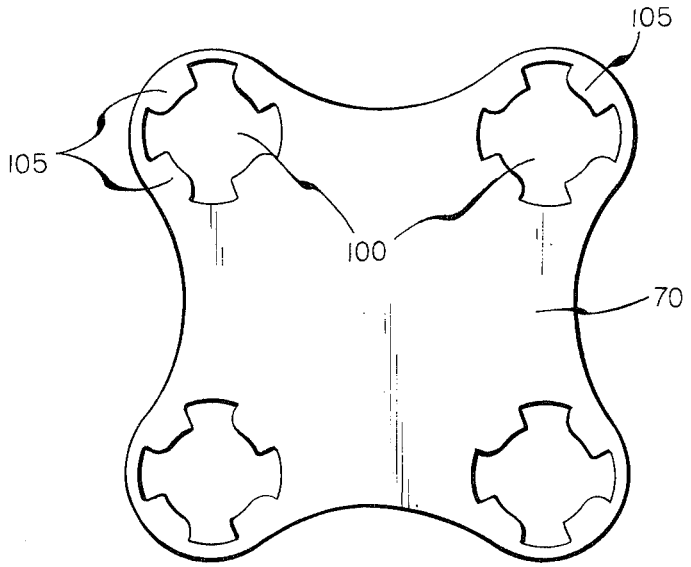
FIG. 4 is a plan view of the connector means of the present invention.
Figure 5:
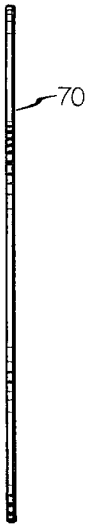
FIG. 5 is a side elevational view of the planer connecting member of the present invention.
Figure 6:
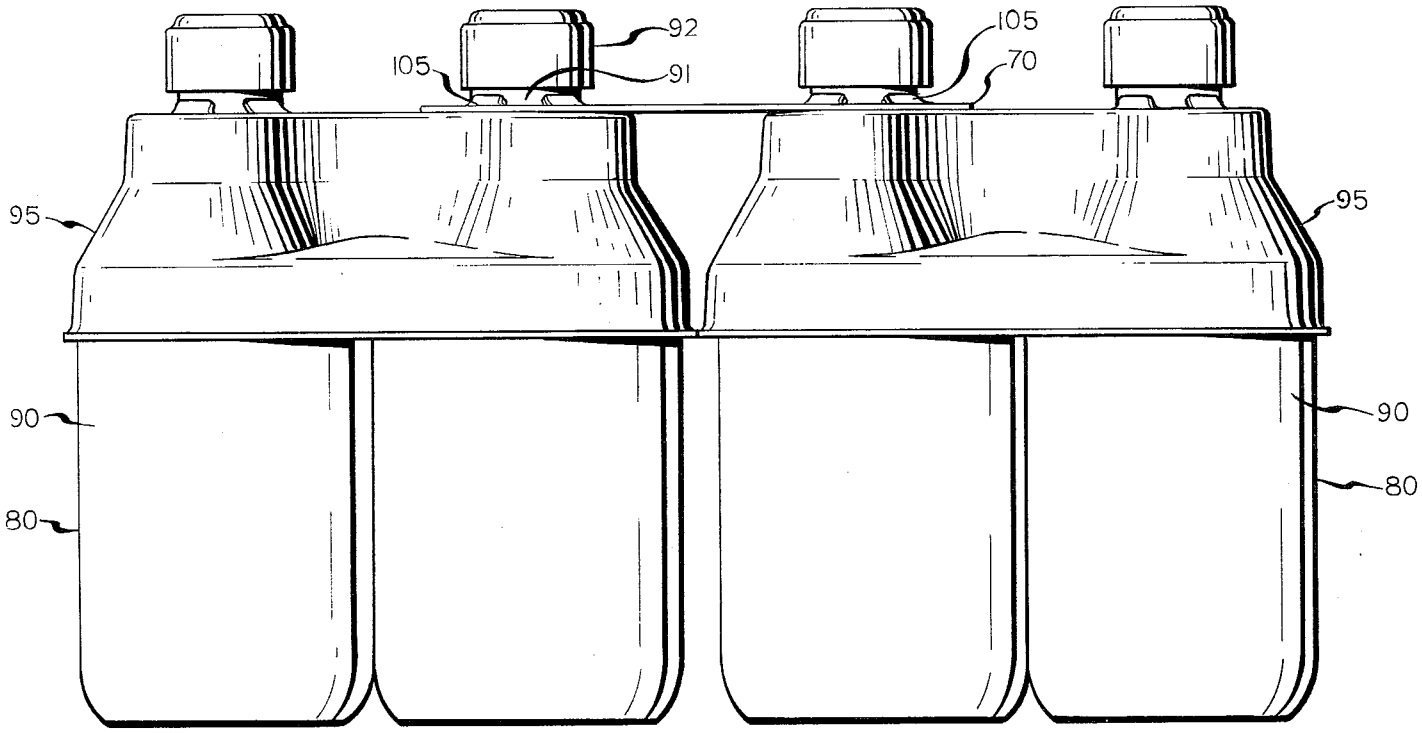
FIG. 6 is a side elevational view of the package in FIG. 3 showing the connector member and the two packs joined and connected together.

FIG. 3 shows a preferred embodiment of the present invention in which a connector 70 engages two four-packs 80. Each four-pack has four bottles 90 each with a bottle finish 91 and a cap 92. As also shown in FIGS. 4 and 5, connector means 70 has a series of holes 100 for engaging the finish 91 of each of the bottles in the rows of the four-packs nearest each other. The holes 100 are formed from the connector material and have a series of fingers 105 that engage the finish 91 of each of the bottles as the bottle finish is pushed through the hole 100. The connector 100 is preferably planer in shape as shown in FIG. 5. As shown in FIG. 6, the connector 70 is seen engaging each of the top carriers 95 of the four-packs, each of the bottles in the four-pack is held together by the top carrier 95 and the two four-backs are readily and easily converted to an eight-pack by the use of the connector 70.

Figure 7:
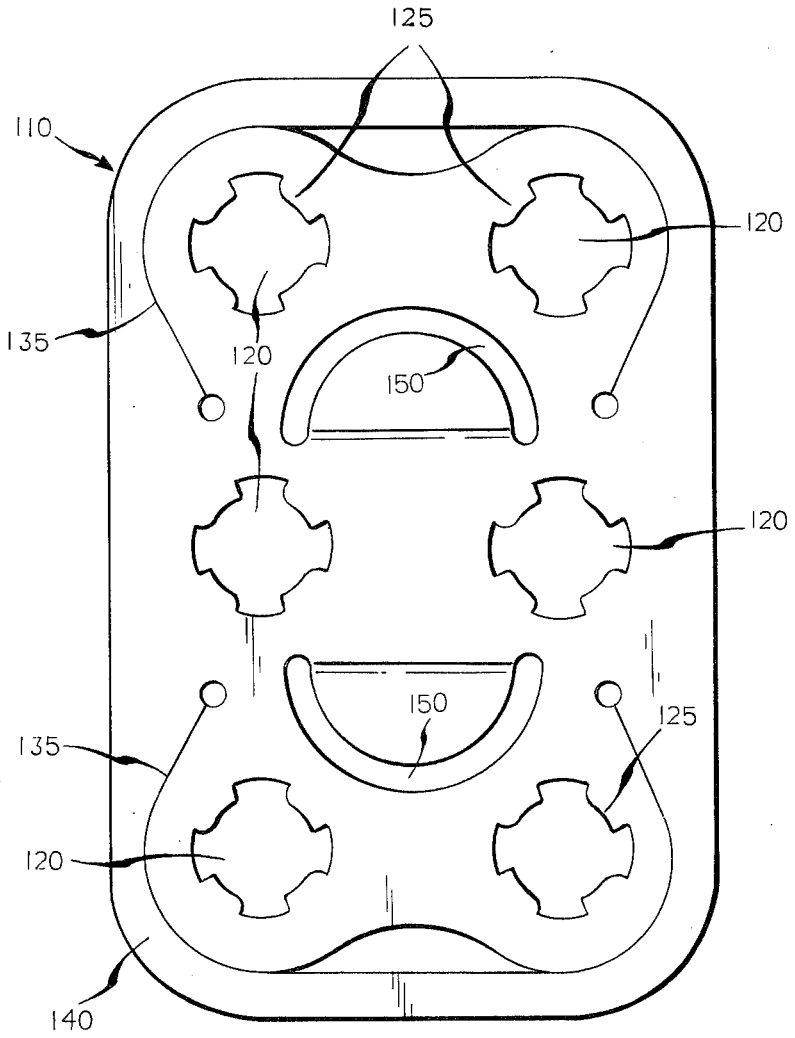
FIG. 7 is a plan view of another embodiment of a connector means for connecting two six-packs together.

FIG. 7 shows another embodiment of a connector 110 for connecting together two six-packs to make a stable, portable twelve-pack package. As in the case of connector 10 shown in FIG. 1 and connector 70 shown in FIG. 3, a series of holes 120 are provided for the finishes of containers. Each hole 120 is formed with fingers 125 to grip the respective container finish that is pushed through the hole. a slit 135 is provided at each end of the connector to provide a downwardly slanted member 140 to be braced against each of the top carriers of the six-packs being joined.

A pair of curved slots 150 is provided near the center of the connector for a stable, convenient hand grip for the package.

Good results have been obtained by connecting two four-packs in which each bottle in the pack is of a 16-ounce capacity. Good results have been obtained by connecting two six-packs of 10-ounce bottles to form a twelve-pack package of 10-ounce bottles.

It can be seen that even though some of the bottles in each of the packs are not directly connected and contacted by the connector member, nevertheless, a sturdy, portable, economical package is provided. As seen in FIG. 6, the bottles contacted by the connector of its top carrier are held securely by the fingers 105 of the connector and the fingers of the corresponding top carrier, each one gripping the finish of the commonly held bottle in alternate fashion around the periphery of the finish.

The normally flat thermoplastic sheet 110 shown in FIG. 5 is so constructed and arranged that it serves also as a top carrier as well as an outstanding connector. The sheet 110 has the holes 120, each hole being adopted to engage the finish of a container such as a bottle of a multi-container pack. In the embodiement shown in FIG. 7, the carrier 110 holds six containers. The planar sheet 110 has the end portions 135 that are bendable to provide means for hand carrying the multi-container pack. The sheet 110, with its bendable portions 135 and the holes 120, is so constructed and arranged that each container in the multi-pack is held in a substantially vertical position during storage while being hand carried.

What is claimed is:

1. A package comprising a first and a second multi-container pack and a thermoplastic connector therefor, each multi-container pack comprising at least four containers, each container having a top finish, a top carrier for engaging the finish of each container in each of the first and second packs, the connector having means for hand carrying the package, the connector being substantially planar and engaging each at least two finishes of the containers in each pack to provide a stable portable package, the connector having openings to engage and receive the container finishes, each opening having a plurality of fingers around its circumference projecting inwardly to engage and grasp the container finish, the number of containers in the multi-container packs being twice the number of openings in the connector.

2. A package comprising a first and second multi-container pack and connector carrier means for connecting the packs adapted for carrying the package from the top, each pack having an inner row of containers of at least two containers and an outer row of at least two containers, each container having a top finish, each pack having a top carrier that engages the top finish of each container, the connector being substantially planar without depending tap portions to contact the containers, the connector having means for carrying the package, the connector engaging the finish of each container in the row of the pack that is nearest the other pack to provide a stable package, the connector having four to six openings to engage and receive the container finishes, each opening having a plurality of fingers around its circumference projecting inwardly to engage and grasp the container finish, the number of containers in the multi-container packs being twice the number of openings in the connector.

3. A package as defined in claim 1 in which each pack has 4 containers.

4. A package as defined in claim 1 in which each pack has 6 containers arranged in 2 rows, the connector engaging the finishes of 3 containers in row of each pack adjacent the other pack.

5. A package as defined in claim 4 in which the top carrier of each pack has pick-up holes for carrying the package.

6. A package as defined in claim 1 in which the connector has four openings, each opening being circular.

7. A package as defined in claim 6 in which the thermoplastic is polyethylene.

8. A normally flat planar thermoplastic sheet adapted for connecting two multi-container packs to form a package that can be carried from the top, the sheet also adapted for use as a top carrier for a multi-container pack to form a six-pack or the like, the sheet having openings to engage the finishes of containers, there being a hole for each container finish in the multi-container pack, the sheet having handle means near the center portion and thereof for hand carrying the multi-container pack, the sheet being a connector for two multi-container packs, the connector having generally circular openings to engage and receive the container finishes, each opening having a plurality of fingers around its circumference projecting inwardly to engage and grasp the container finish, the number of containers in the multi-container packs being twice the number of openings in the connector.

9. A normally flat sheet of thermoplastic material for carrying a multi-container pack, the sheet having holes therein for engagement of the finishes of containers, there being one hole for each container finish, the sheet having end and center portions that are bendable to provide hand-holds for carrying the multi-container pack, the sheet with the bendable portions and holes so constructed and arranged that each container is held in a substantially vertical position when being carried, the sheet being a connector for two multi-container packs, the connector having generally circular holes to engage and receive the container finishes, each hole having a plurality of fingers around its circumference projecting inwardly to engage and grasp the container finish, the number of containers in the multi-container packs being twice the number of holes in the container.

10. A normally flat planar polyethylene sheet adapted for carrying a multi-container pack at the top of the pack, the sheet having a plurality of holes therein, each hole being adapted for engaging the finish of each container in the multi-container pack, the sheet having end portions that are bendable to provide means for carrying by hand the multi-container pack, the bendable end portions and the holes in the sheet being so constructed and arranged that each container in the multi-pack is held in a substantially vertical position during storage and while being hand carried, the sheet being a connector for two multi-container packs, the connector having four to six holes to engage and receive the container finishes, each hole having a plurality of fingers around its circumference projecting inwardly to engage and grasp the container finish, the number of containers in the multi-container packs being twice the number of holes in the connector.

* * * * *